United States Patent [19]

Shiga et al.

[11] 4,057,504

[45] Nov. 8, 1977

[54] METHOD OF PREPARING OVERBASED LUBRICATING OIL ADDITIVES

[75] Inventors: Michio Shiga, Fujisawa; Kimitoshi Hirano, Kawasaki; Matsuo Matsushita, Yokohama, all of Japan

[73] Assignee: Karonite Chemical Co., Ltd., Tokyo, Japan

[21] Appl. No.: 743,860

[22] Filed: Nov. 22, 1976

[30] Foreign Application Priority Data

Dec. 15, 1975 Japan ..... 50-149275

[51] Int. Cl.[2] ..... C10M 1/40; C10M 3/34; C10M 5/22; C10M 7/38

[52] U.S. Cl. ..... 252/33; 252/18; 252/25

[58] Field of Search ..... 252/18, 25, 33, 39

[56] References Cited

U.S. PATENT DOCUMENTS

| | | | |
|---|---|---|---|
| 3,178,368 | 4/1965 | Hanneman | 252/18 |
| 3,194,761 | 7/1965 | Fox et al. | 252/25 |
| 3,429,811 | 2/1969 | Robbins et al. | 252/33 |
| 3,725,381 | 4/1973 | Sakai et al. | 252/42.7 |

*Primary Examiner*—Delbert E. Gantz
*Assistant Examiner*—Irving Vaughn
*Attorney, Agent, or Firm*—Blanchard, Flynn, Thiel, Boutell & Tanis

[57] ABSTRACT

A method of preparing an overbased lubricating oil additive comprising introducing carbon dioxide into a mixture containing (1) an oil-soluble organic acid or a metal salt thereof, which acid or salt includes a hydrocarbon group having 8 to 150 carbon atoms, and (2) an alkaline earth metal compound selected from the group consisting of oxides or hydroxides of alkaline earth metals, at a temperature of higher than about 100° C, in a reaction medium of a lubricating oil, in the presence of a reaction accelerator comprising a dihydric alcohol, a phenol compound and elemental sulfur, thereby to effect complete carbonation; and thereafter removing all of the volatile components contained in the reaction product.

17 Claims, No Drawings

METHOD OF PREPARING OVERBASED LUBRICATING OIL ADDITIVES

BACKGROUND OF THE INVENTION

1. FIELD OF THE INVENTION

The present invention relates to a method for preparing an oil-soluble, alkaline earth metal-containing composition, and particularly to a method of preparing a composition usable as a detergent for lubricants. More specifically, the present invention relates to an improved method for preparing alkaline earth metal salts of organic acids.

2. DESCRIPTION OF THE PRIOR ART

"Overbasing", which means increasing the basicity of an oil-soluble alkaline earth metal salt of an organic acid, in order to obtain a composition containing substantially larger amounts of alkaline earth metal components than the amounts of the organic acid radicals contained therein, has been commonly practiced in the art. The overbased compositions are useful as lubricating oil additives for maintaining internal combustion engines in a clean state. It is often preferred to use these basic compositions because they exhibit a strong effect of preventing the corrosion that would be caused by the presence of acidic products which are formed by oxidation of sulfur compounds contained in the fuel, hydrochloric acid derived from halogen lead scavengers, etc. Particularly in marine Diesel engines, it is a common practice to use fuels of high sulfur content from which large amounts of acidic products are formed. For this reason, it is desirable to use an alkaline additive which has a high ability of neutralizing acids.

A number of methods for preparing such overbased metal salts have been proposed. Conventional overbased alkaline earth metal salts of organic acids can be prepared by carbonating mixtures which contain organic acids and a stoichiometric excess of alkaline earth metal compounds, in the presence of a reaction accelerator and a reaction medium. The reaction accelerators heretofore used include lower monohydric alcohols having 1 to 6 carbon atoms and glycols such as ethylene glycol. As reaction media heretofore used, there can be mentioned relatively low boiling point organic solvents such as a mixture of xylene and hexane and naphtha.

However, these conventionally prepared overbased metal salts of organic acids do not have satisfactory heat resistance properties, extreme pressure characteristics, anti-wear properties and stability against oxidation, which properties are required for such overbased detergent additives. Moreover, the conventional method of preparation is dangerous because the lower monohydric alcohols, such as methanol and ethanol, which are used as reaction accelerators, and the low boiling point solvents, such as a mixture of xylene and hexane and naphtha, large quantities of which are used as reaction media, are inflammable substances and highly hazardous because fires or exposions can readily occur.

An object of the present invention is, therefore, to provide improved compositions which are advantageous for use as detergent additives for lubricating oils. Another object of the invention is to provide a safe method for preparing such compositions.

The objects of the present invention are attained by effecting carbonation by the use of carbon dioxide, of a carbonatable material, which material contains (1) an organic acid or a metal salt thereof, and (2) an oxide or a hydroxide of an alkaline earth metal, in a reaction medium of a lubricating oil. The invention is characterized by the fact that the carbonation step is carried out in the presence of a reaction accelerator comprising a dihydric alcohol, a phenolic compound and elemental sulfur. The invention is further characterized by the fact that there are not used any low boiling point solvents, such as a monohydric lower alcohol, or a mixture of xylene and hexane and naphtha, which were used in the conventional methods. According to the method of the present invention, it is therefore possible to obtain the desired substances in an extremely safe manner as compared to the conventional technique. Another novel feature of the invention resides in the use of a special reaction accelerator.

When a dihydric alcohol, which has been known to the art as being a useful reaction accelerator, is used by itself in the method of the present invention, wherein a lubricating oil is employed as the reaction medium, such dihydric alcohol causes gelatinization of the reaction mixture during the reaction step. It has been found that the overbased metal compositions of the present invention cannot be obtained effectively when a dihydric alcohol is used alone, as a reaction accelerator. We discovered that an overbased metal salt of an organic acid can be obtained with a good yield, by carrying out the reaction in the presence of a reaction accelerator comprising a dihydric alcohol, a phenolic compound and elemental sulfur.

We have discovered that elemental sulfur, which is one component of the reaction accelerator of the present invention and which is used together with a dihydric alcohol and a phenolic compound, facilitates acceleration of the process reaction to a great extent, and at the same time effectively imparts to the reaction product a higher thermal stability, a good extreme pressure characteristic, an effective anti-wear property and an oxidation-preventing property. It is, therefore, a further object of the present invention to provide improved lubricating oil additives prepared by using such an accelerator composition.

The method of the present invention for preparing overbased metal salts of organic acids will be more specifically described hereinbelow.

A lubricating oil as a reaction medium, (1) an organic acid or a metal salt thereof and (2) an oxide or hydroxide of an alkaline earth metal are put into a reaction vessel and agitated at about 15° to 80° C to form an emulsion. The emulsion is then heated up to 120° to 200° C. Then, a phenolic compound and elemental sulfur are added to the emulsion and thereafter a dihydric alcohol is slowly added thereto. As soon as the dihydric alcohol is added, the reaction starts with formation of hydrogen sulfide and water. If the dihydric alcohol is rapidly added, a vigorous reaction proceeds. This undesired reaction rapidly increases a temperature of the reaction mixture and formation of a large amount of hydrogen sulfide, which are very dangerous. In order to overcome such a danger, it is preferable according to this invention that the dihydric alcohol is slowly added over 0.5 hour or longer, especially 1 to 2 hours. The reaction is continued under atmospheric pressure, or preferably under a reduced pressure, for 1 to 5 hours until distillation of the water formed by the reaction is terminated. Since the reaction hardly proceeds at a temperature lower than the melting point of sulfur, 120° C, it must be effected at a temperature of 120° C or higher, preferably 150° to 200° C. In order to completely remove out the water and hydrogen sulfide as formed by the reaction, the reaction is preferably carried out under a reduced pressure, especially at a pressure of 500 to 710 mmHg. It is the reason why the water must be completely removed out of the reaction system that otherwise there would be caused carbonation, especially gelation and muddiness of the final product.

Thereafter, carbon dioxide is blown into the mixture at above 100° C, preferably 150° to 180° C, more preferably 175° to 180° C. While carbon dioxide is absorbed into the reaction mixture and carbonation proceeds, the viscosity of the reaction mixture is reduced. The carbonation converts the alkaline earth metal compound into the carbonate thereof, which is dispersed in the form of colloid in a lubricating oil. Therefore, an amount of solid components such as the alkaline earth metal compound is decreased. When an amount of the solid components becomes below 2% by volume of the reaction mixture, preferably below 1% by volume, the blowing of carbon dioxide into the mixture is stopped. If further carbon dioxide is blown thereinto, large amounts of solid components are formed, which will result in troubles in the filtration and in the solubility in a lubricating oil. Therefore excess carbon dioxide must not be added. An amount of solid components in the reaction mixture was determined in accordance with ASTM D-91 "Standard Method of Test for Precipitation Number of Lubricating Oils". After the completion of carbonation, the volatile components such as the dihydric alcohol are distilled off at a temperature of about 150° to 220° C under a reduced pressure of 10 to 50 mmHg. The residue is filtered with the use of a filter aid, such as diatomaceous earth, whereby to obtain the composition of the present invention.

In the method of the present invention, the ratio of the amount of organic acid to the amount of the alkaline earth metal compound used can be varied depending on the desired properties of the final composition. More specifically, when an excess of the alkaline earth metal compound is added to an oily solution containing one chemical equivalent of an organic acid, one chemical equivalent of the alkaline earth metal reacts with the organic acid to form a metal salt of the organic acid, and the remaining alkaline earth metal compound reacts with the carbon dioxide to form a colloidal carbonate of the alkaline earth metal, which colloidal carbonate is dispersed in the lubricating oil by the action of the metal salt of the organic acid.

The overbase of a composition as obtained by the method of this invention is defined by the term "metal ratio", which means the ratio of weights of the overbased alkaline earth metal to the alkaline earth metal neutralized with an organic acid. The former metal is present in a carbonate dispersed in the composition. It can be calculated by the following equation: Metal ratio $= (T-N/N)$, in which T stands for a total weight of the alkaline earth metal contained in the composition of this invention, N stands for a weight of the alkaline earth metal present in the salt of an organic acid. As above mentioned, one chemical equivalent of the alkaline earth metal reacts with the organic acid. If a composition is not overbased, therefore, the metal ratio is zero. Higher is the metal ratio, more overbased is the composition. According to this invention the metal ratio can be varied in the range of from 2 to 15, or even higher.

The amount of reaction accelerator used in the present invention is determined depending upon the amount of the added alkaline earth metal compound. The reaction accelerator of the present invention comprises from 0.5 to 1.2 mols of a dihydric alcohol, from 0.01 to 0.2 mols of a phenolic compound and from 0.1 to 0.6 gram atoms of elemental sulfur, per one mole of the alkaline earth metal compound employed. However, a larger amount, than described above, of the reaction accelerator can be used.

The amount of carbon dioxide introduced into the reaction mixture is varied depending on the desired basicity of the final composition. In general, it is required to introduce a stoichiometric excess amount of carbon dioxide, based on the unreacted alkaline earth metal compound, in order to obtain a composition of the desired basicity.

Oil-soluble organic acids and salts thereof used in the present invention include organic carboxylic acids and salts thereof and organic sulfonic acids and salts thereof. Examples of the organic carboxylic acids preferably used in the present invention are higher fatty acids which have hydrocarbon groups having from about 8 to about 150 carbon atoms such as alkyl groups, alkenyl groups or aralkyl groups; hydrocarbon-substituted carboxylic acids; and naphthenic acids. As preferable carboxylic acids there can be mentioned fatty acids such as 2-ethylhexyl acid, myristic acid, palmitic acid, stearic acid, isostearic acid, oleic acid, linoleic acid, linolenic acid and tall oil fatty acids; hydrocarbon-substituted lower alkyl carboxylic acids such as propionic acids substituted by aliphatic hydrocarbons having 8 to 150 carbon atoms; and naphthenic acids. Naphthenic acids are contained in the heavy naphtha obtained from petroleum, kerosene, gas oil and certain kinds of lubricating oil fractions, and they can be separated in the form of their sodium salts by extraction with sodium hydroxide and they are generally obtained in the form of the free acids by sulfuric acid treatment. The naphthenic acids thereby obtained are mixtures of different acids mainly composed of saturated monocylic carboxylic acids, saturated dicyclic carboxylic acids and alkyl carboxylic acids. The molecular weights of the preferred naphthenic acids range from 200 to 1500. Dicarboxylic acids such as alkylor alkenyl-substituted succinic acids can also be used. The preferred metal salts of these carboxylic acid are the magnesium, calsium and barium salts.

The sulfonic acids and salts thereof preferably used in the present invention are oil-soluble. Such sulfonic acids include the so-called mahogany acids such as oil-soluble aromatic petroleum sulfonic acid, alkylsulfonic acid, arylsulfonic acid and alkyl-arylsulfonic acid. Specific examples of sulfonic acids are postdodecylbenzenesulfonic acid, dilaurylcetylbenzene sulfonic acid, paraffin wax-substituted benzenesulfonic acid, polyisobutylene-substituted benzenesulfonic acids having molecular weights of about 300 to about 1000, naphthalenesulfonic acid and alkyl-substituted naphthalenesulfonic acid. The preferred metal salts of these sulfonic acids are the magnesium, calcium and barium salts.

The most preferred sulfonate is calcium postdodecylbenzene sulfonate.

Examples of the oxides or hydroxides of alkaline earth metals, i.e. metal elements belonging to group II of the periodic table, are magnesium oxide, magnesium hydroxide, calcium oxide, calcium hydroxide, barium oxide and barium hydroxide. The most preferable compounds are calcium oxide and calcium hydroxide.

The reaction accelerator usable in the present invention comprises a dihydric alcohol, a phenolic compound and elemental sulfur.

Examples of dihydric alcohols that can be employed are those having not more than 6 carbon atoms such as ethylene glycol, propylene glycol, butylene glycol, amylene glycol, pentyne glycol, diethylene glycol, trimethylene glycol, 1,3-butylene glycol and hexylene glycol. Ethylene glycol is most preferred because it is highly active.

The preferred phenolic compounds are alkyl phenols having from about 4 to about 100 carbon atoms. Such alkyl phenols can be easily obtained by reacting olefinic hydrocarbons with phenol in the presence of a suitable catalyst. Examples of olefinic hydrocarbons which can be used for preparing alkyl phenols are monomers or polymers of 1-monoolefins such as 1-butene, isobutene, 1-hexene and 1-octene.

Natural sulfur, sulfur obtained from underground sources and sulfur recovered in the refining operation of petroleum can be used as elemental sulfur in the present invention.

If a reaction accelerator consisting of ethylene glycol alone is used in the method of the present invention, the reaction mixture loses its fluidity completely and gelatinizes in the dehydration step prior to introduction of carbon dioxide and, as a result, carbonation of the mixture becomes impossible. It has thus been found that the compositions of the present invention cannot be obtained when a dihydric alcohol is used by itself.

Gelatinization of the reaction mixture does not occur in the presence of a reaction accelerator which is formed by combining ethylene glycol with elemental sulfur, and the mixture can be easily carbonated. However, another problem arises in filtering the thus-obtained product. On the other hand, when a reaction accelerator comprising ethylene glycol, a phenolic compound and elemental sulfur is used, the carbonation reaction proceeds extremely easily to give a product having a metal ratio of higher than 5 with a good yield.

The lubricating oil medium used as a reaction medium in the present invention facilitates handling of the reaction product and is advantageously used for obtaining an oily solution or an oily composition of the product. Mineral and synthetic lubricating oils can be used.

The chemical structures of the reaction products obtained by the method of the present invention have not been made clear. For this reason, the present invention has been explained by reference to the method for preparing same. It is believed that the reaction products of the invention are formed by the following reactions. However, it should be noted that the present invention is not limited to the accuracy of the following theoretical considerations. In the first reaction step, the carboxylic acids and alkaline earth metal compounds react with each other to form neutral salts having the formula:

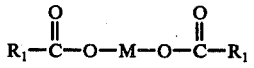

(Product A)

In the above chemical formula, M is an alkaline earth metal such as magnesium, calcium or barium, and $R_1$ is a hydrocarbon group having from 8 to about 150 carbon atoms. The reaction accelerator used in the present invention which comprises a dihydric alcohol such as ethylene glycol, a phenolic compound and elemental sulfur, reacts with the alkaline earth metal compound such as calcium hydroxide to form a complex having the formula of Product B:

(Product B)

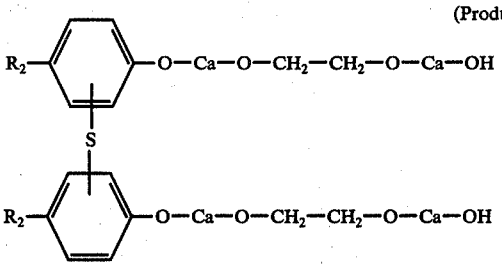

In the above formula, $R_2$ represents an alkyl group having 4 to 100 carbon atoms.

The complexes shown by Product B above are soluble in substances obtained from petroleum such as lubricating oils. The reaction that takes place when a reaction accelerator including only a dihydric alcohol such as ethylene glycol and the like is considered to be represented by the following reaction scheme of:

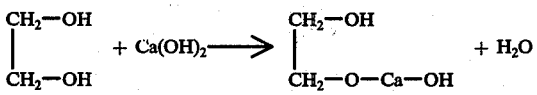

Calcium glycoxide formed by the above reaction is a viscous substance which is not soluble in a lubricating oil, it causes gelatinization of the reaction mixture and makes it impossible to continue the reaction. In order to fluidize the reaction mixture and to make it possible to continue the reaction, higher alcohols such as those having more than 6 carbon atoms can be used. However, the addition of higher alcohols is not preferred because they decrease the hydroscopic stability fo the mixture. The above Product B is formed in the reaction step as an intermediate product and is decomposed in the carbonation step effected by the introduction of carbon dioxide, as follows:

(Product B) + $3CO_2$ + $H_2O$

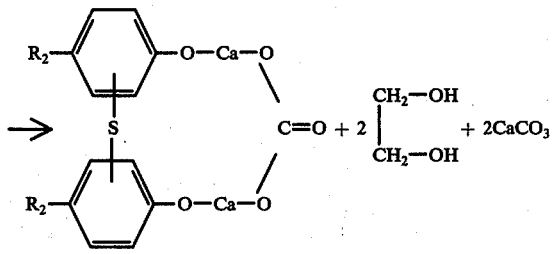

(Product C)

It is believed that the calcium carbonate formed by the above reaction is dispersed in the oil reaction medium in the form of a stable colloid, thereby to constitute the overbasing component in the composition, by the combined functions of Products A and B which act as oil-soluble surface active agents or dispersing agents. The ethylene glycol thus formed can be recovered for reuse by distillation.

The quantities of the various starting components used for preparing the final products can be varied in a wide range. For example, the amounts of the oil-soluble dispersing agents represented by the Products A and B can be varied so as to be from about 20 to about 50 wt.% of the total weight amount of the final composition. The amount of lubricating oil reaction medium can be varied so as to be from about 30 to about 70 wt.% of the total weight of the final composition, and the amount of the carbonated inorganic compound can be varied so as to be from about 4 to about 35% of the total weight of the final composition.

The final composition obtained by the above-described preparation method possesses a superior property of neutralizing acidic products formed by combustion of fuel and by deterioration of the lubricating oil when said final compositions are added to the lubricating oil in an amount of from about 0.1 to about 40% by weight, preferably about 10 to about 30% by weight. According to the present invention, it is possible to provide lubricating oil compositions which are highly effective for maintaining the interior of internal combustion engines in a clean state.

The compositions provided by the present invention can be used in combination with other lubricating oil additives such as a cleaning dispersant, an antioxidant, an extreme pressure agent, a corrosion preventing agent, a viscosity index improver and a pour point depressant.

In the following description, there will be set forth illustrative Examples of the methods for preparing compositions of the present invention and the test results of the lubricating oil compositions containing the compositions according to the invention. However, the present invention is not limited to the specific embodiments described hereinbelow.

The total base number shown in the Test Examples below is determined by conducting potentiometric titration wherein a sample is dissolved into a mixed solution of monochlorobenzene and acetic acid and is titrated with a standard solution of perchloric acid in accordance with the test method prescribed in JIS-K-2500 (corresponds to ASTMD-2896) under the title of "Standard method of test for total base number of petroleum products by potentiometric perchloric acid titration". The total base number of the respective samples is shown by milligram unit of KOH equal to the equivalent concentration of an acid required for neutralizing 1 gram of each sample.

EXAMPLE 1

669 g of a lubricating oil (viscosity at 100° F: 100 SSU), 336 g (1.2 mols) of oleic acid having a neutralization value of 200 and 242 g (3.3 mols) of calcium hydroxide were put into a reaction vessel provided with an agitator, a pipe for removing water, a port for charging the starting materials and a thermometer, and the mixture was agitated at 50° C to 60° C to obtain a slurry. The slurry was then heated to 180° C and to it were added 21 g (0.1 mol) of octylphenol and 37.5 g (1.2 gram-atoms) of sulfur. Further, 117 g (1.9 mols) of ethylene glycol was slowly added to the mixture over a period of 2 hours. The mixture was maintained at 180° C for 5 hours under a reduced pressure of 710 mmHg. After the formed water was removed, carbon dioxide was blown into the mixture maintained at 185° C to 190° C, under atmospheric pressure, until the volume of the precipitate in the reaction mixture was decreased so as to be smaller than 1% by volume. After the completion of carbonation, the mixture was subjected to distillation at 210° C to 220° C, under a reduced pressure of 20 mmHg, thereby to remove ethylene glycol. Diatomaceous earth, as a filter acid, was added to the distillation residue and the admixture was filtered. The obtained liquid product was a yellow-brown viscous liquid having a total base number of of 284.3 and containing 10.2 wt.% of calcium and 1.9 wt.% of sulfur. Calculated neutral calcium was 1.9 wt.% and the metal ratio thereof was 4.4.

Comparison Example 1

The reaction was carried out following the procedure set forth in Example 1, except that octylphenol and sulfur were not used. The reaction mixture lost its fluidity and gelatinized during the dehydration step and it became difficult to continue the reaction.

Reference Example 2

The reaction was carried out following the procedure set forth in Example 1 except that octylphenol was not used. No disadvantageous abnormal state was observed in both of the dehydration and carbonation steps. However, difficulties were encountered in filtering the reaction product.

EXAMPLE 2

425 g of a lubricating oil, 360 g (0.58 mols) of a naphthenic acid having acid value of 90, and 242 g (3.3 mols) of calcium hydroxide were mixed and a suspension was formed in accordance with the method described in Example 1. The suspension was heated to 180° C and 168 g (0.62 mole) of dodecylphenol and 37.5 g (1.2 gram-atoms) of elemental sulfur were added and then 117 g (1.9 moles) of ethylene glycol was added. The reaction was completed in the same way as described in Example 1. The obtained reaction product was a dark brown viscous liquid having a total base number of 287.4 and containing 10.4 wt.% of calcium and 2.2 wt.% of sulfur. Calculated neutral calcium of the product was 0.9 wt.% and the metal ratio thereof was 10.6.

EXAMPLE 3

The reaction was carried out in the same manner as in Example 1, except that 185 g (3.3 moles) of calcium oxide was used instead of calcium hydroxide. There was obtained a product composition having the same properties as those of Example 1.

EXAMPLE 4

425 g of a lubricating oil and 360 g (0.58 mole) of naphthenic acid having an acid value of 90 were mixed and the mixture was heated up to 80° C. Then 22 g (0.3 mole) of calcium hydroxide was added to the mixture, which was further heated up to 150° C. The reaction was carried out under a reduced pressure of 510 mmHg for 2 hours while the water formed was removed off to obtain a lubricating oil solution of calcium naphthenate. Thus obtained calcium naphthenate was mixed with 220 g (3.0 moles) of calcium hydroxide at 80° C. After the mixture was heated up to 180° C, and to it were added 168 g (0.68 mole) of dodecylphenol and 37.5 g (1.2 gram atom) of sulfur. Further, 117 g (1.9 moles) of ethylene glycol was slowly added to the mixture over a period of 45 minutes, followed by the same manner as in Example 1. The obtained product was a dark brown, viscous liquid having a total base number of 286.5 and containing 10.3 wt.% of calcium and 2.2 wt.% of sulfur. An amount of the neutralized calcium of the product was calculated as 0.93 wt.% and the metal ratio was 10.1.

EXAMPLE 5

168 g (0.37 mole) of a polybutene-substituted phenol (which had been prepared by reacting phenol with an equal number of mols of a polybutene having an average carbon atom number of 25 at 120° C to 138° C in the presence of activated clay) was used in place of the dodecylphenol used in Example 2. The obtained product was a dark brown viscous liquid having a total base number of 290.5 and containing 10.5 wt.% of calcium and 2.3 wt.% of sulfur. Calculated neutral calcium of this product was 0.9 wt.%, and metal ratio thereof was 10.7.

EXAMPLE 6

To 500 g of a lubricating oil solution of barium naphthenate containing 5.1 wt.% of barium, was added 80 g (0.47 mole) of barium hydroxide to obtain a slurry. After the slurry was heated up to 140° C, to it were added 24 g (0.09 mole) of dodecyl phenol and 6.5 g (0.2 gram atom) of sulfur. Further, 31 g (0.5 mole) of ethylene glycol was slowly added thereto over a period of 45 minutes, followed by the same manner as in Example 1. The obtained product was a dark brown, viscous liquid having a total base number of 130.5 and containing 16.2 wt.% of barium and 0.6 wt.% of sulfur. An amount of the neutralized barium was calculated as 4.7 wt.% and the metal ratio was 2.4.

EXAMPLE 7

500 g of calcium postdodecylbenzene sulfonate (Ca content: 1.7%) containing about 60 wt.% of a lubricating oil and 63.0 g (0.86 mole) of calcium hydroxide were mixed to form a slurry in the same way as described in Example 1. The slurry was heated to 180° C and to it were added 34.6 g (0.12 mole) of dodecylphenol and 13.2 g (0.42 mole) of elemental sulfur. After adding 42 g (0.68 mole) of ethylene glycol, the reaction was completed in the same way as described in Example 1. The obtained product was a yellow-brown viscous liquid containing 7.0 wt.% of calcium and having a total base number of 158. Calculated neutral calcium of this product was 1.4 wt.% and metal ratio thereof was 4.0.

EXAMPLE 8

A mixture of 400 g (0.81 mole) of an alkyl benzene sulfonic acid having the molecular weight of 491, 400 g of a lubricating oil and 300 g (4.05 moles) of calcium hydroxide was heated up to 80° C to obtain a slurry. After the mixture was further heated up to 140° C, to it were added 15 g (0.06 mole) of dodecylphenol and 13 g (0.41 gram atom) of sulfur. Further, 250 g (4.0 moles) of ethylene glycol was slowly added thereto over a period of one hour. Thereafter the mixture was heated up to 180° C and the reaction was effected under a reduced pressure of 710 mmHg for 3 hours while the water and hydrogen sulfide formed were removed off. Then, carbonation was effected in the same manner as in Example 1. The obtained product was a dark brown, viscous liquid having 11.2 wt.% of calcium and the total base number of 279.5. An amount of the neutralized calcium was calculated as 1.1% and the metal ratio was 9.2.

Test Example

In order to examine the utility of the overbased compositions of the present invention as lubricating oil additives, the respective compositions were added to SAE-40 lubricating oil of mineral oil system having a viscosity index of 95, and each of the admixed lubricating oils was subjected to the evaluation tests described hereinbelow. The test results showed that the compositions of the present invention are extremely effective for use as detergents for internal combustion engines. The additives and the amounts thereof added to the lubricating oil used in the evaluation tests are set forth below.

| Additive | Specified Composition of Additive | Content of Additive (% by weight) |
|---|---|---|
| Additive A | The product obtained by Example 1 of the present invention (Ca = 10.2 % by weight) | 27.4 |
| Additive B | The product obtained by Example 2 of the present invention (Ca = 10.4 % by weight) | 26.9 |
| Commercial additive-1 | Commercially available overbased calcium sulfonate (Ca = 11.4 % by weight) | 24.5 |
| Commercial additive-2 | Commercially available overbased calcium naphthenate (Ca = 9.5 % by weight) | 29.5 |
| Commercial additive-3 | Commercially available overbased calcium phenate | 31.3 |

The commercially available additives 1, 2 and 3 set forth in the above Table are commonly used as detergents and acid neutralizers for high alkaline lubricating oils used in marine Diesel engines.

The contents of the additives set forth in the above Table were determined so as to adjust the content of calcium in the final compositions to be 2.8% by weight, which is the same as those of the additives in lubricating oils used for cleaning cylinders of large-sized marine Diesel engines.

Test Examples 1 - 2: Reference Test Examples 1 - 3

These Examples show the test results of the oxidation stabilities of the lubricating oils for internal combustion engines.

The tests were conducted in accordance with the method prescribed in JIS-K-2514. JIS-K-2514 is the same method as described in Industrial and Engineering Chemistry, Analytical edition, vol. 13, No. 5, page 317 (1941). Iron and copper pieces were immersed into the sample oils as catalysts for oxidation and the oils were oxidized by agitating them in air at 165.5° C for 48 hours. The results of the tests are shown in the following Table.

| Test Number | Additive Contained in the tested oil | Viscosity Ratio | Increase in Total Acid Number (KOH mg/g) | Lacquer |
|---|---|---|---|---|
| Test Example 1 | Additive A | 1.11 | 1.26 | No adhesion |
| Test Example 2 | Additive B | 1.06 | 1.21 | No adhesion |

-continued

| Test Number | Additive Contained in the tested oil | Viscosity Ratio | Increase in Total Acid Number (KOH mg/g) | Lacquer |
|---|---|---|---|---|
| Ref. Example 1 | Commercial additive-1 | 1.47 | 4.14 | No adhesion |
| Ref. Example 2 | Commercial additive-2 | 4.45 | 0.33 | No adhesion |
| Ref. Example 3 | Commercial additive-3 | 1.11 | 3.23 | No adhesion |

From the results of the oxidation stability tests set forth in the above Table, it is appreciated that both of the additives A and B of the present invention are superior to the commercially available additives in their increases in viscosity ratios and total acid number.

Reference Example 3 – 4: Reference Test Examples 4 – 6

These Examples show the results of Panel coker tests.

The products of the present invention were subjected to the Panel coker test for testing their cleaning properties at high temperature. Using a testing instrument which is generally in accord with that prescribed in United States Federal Test Method 791a–3462, the tests were conducted at 315° C for 5 hours under the cyclic conditions wherein oils were splashed for 1 second and then the splashing of oils were stopped for the following 9 seconds. The lubricating oils and additives were evaluated in these tests by measuring the increase in weight of the deposit that adhered to the panels. The results of the tests are set forth below.

| Test Number | Additive Contained in the tested oil | Increase in Weight of the Panel (mg) |
|---|---|---|
| Test Example 3 | Additive A | 25.5 |
| Test Example 4 | Additive B | 27.0 |
| Ref. Example 4 | Commercial additive-1 | 133.0 |
| Ref. Example 5 | Commercial additive-2 | 42.0 |
| Ref. Example 6 | Commercial additive-3 | 31.5 |

As shown in the test results set forth in the above Table, it is appreciated that both of the additives A and B of the present invention exert effective detergency functions even at high temperature and they have detergency functions higher than those of the commercially available additives.

Test Examples 5 – 6: Reference Test Examples 7 – 9

These Examples show the test results of anti-wear properties.

The anti-wear properties of the products of the present invention were tested using Shell's four ball testing machine. The Shell four ball testing machine employed is the same machine as described in ASTM D-2783. But the test conditions are different from the ASTM standard. In this wear test, the anti-wear properties of lubricating oils and additives are shown by the sizes of the scratches formed on the surfaces of the fixed balls. The diameters of the scratches formed by wear were measured in the directions parallel to and perpendicular to the sliding direction using a microscope and the average diameters were calculated in mm units. The tests were conducted for 1 hour under a load of 40 Kg. The test results are shown as follows:

| Test Number | Additive Contained in the tested oil | Scratch Diameter (mm) |
|---|---|---|
| Test Example 5 | Additive A | 0.33 |
| Test Example 6 | Additive B | 0.32 |
| Ref. Example 7 | Commercial additive-1 | 0.40 |

-continued

| Test Number | Additive Contained in the tested oil | Scratch Diameter (mm) |
|---|---|---|
| Ref. Example 8 | Commercial additive-2 | 0.36 |
| Ref. Example 9 | Commercial additive-3 | 0.37 |

It has been ascertained by these tests that the lubricating oils containing either of the additives A or B of the present invention gave smaller size abrasion scratches than those observed when using oils containing commercially available detergent agents, and that the compositions of the present invention have excellent anti-wear properties.

As clearly shown by the test results, the overbased metal compositions of the present invention exhibit superior functional effects when used as additives for lubricating oils.

The embodiments of the invention in which an exclusive property or privilege is claimed are defined as follows:

1. A method for preparing an overbased lubricating oil additive, which comprises the steps of:

I. forming a mixture consisting essentially of (1) an oil-soluble organic acid, or a metal salt thereof, wherein said organic acid is selected from the group consisting of hydrocarbon carboxylic acids and hydrocarbon sulfonic acids wherein the hydrocarbon group has from 8 to 150 carbon atoms, and (2) a compound selected from the group consisting of alkaline earth metal oxides and alkaline earth metal hydroxides, in a lubricating oil as a reaction medium, the metal ratio being in the range of from 2 to 15, II. adding to said mixture an accelerator composition consisting essentially of (a) from 0.5 to 1.2 moles of a dihydric alcohol having from 2 to 6 carbon atoms, per one mole of component (2) in said mixture, (b) from 0.01 to 0.2 moles of an alkyl phenol having from about 4 to 100 carbon atoms in the alkyl groups, per one mole of component (2) in said mixture, and (c) from 0.1 to 0.6 gram atoms of elemental sulfur, per one mole of component (2) in said mixture, heating the mixture to a temperature above 120° C and effective to cause the reaction in the liquid phase, until the water formed by the reaction is distilled off; and then III. blowing carbon dioxide gas into the reaction mixture obtained in step II, at a temperature above 100° C, to transform at least part of the excess of alkaline earth metal into the corresponding carbonate, and distilling off the volatile substances from the reaction product to obtain the overbased lubricating oil additive.

2. A method as claimed in claim 1 in which said oil-soluble organic acid is selected from the group consisting of aromatic petroleum sulfonic acids, alkyl sulfonic acids, aryl sulfonic acids, alkylaryl sulfonic acids, and salts thereof.

3. A method as claimed in claim 1 in which said oil-soluble organic acid is selected from the group consisting of postdodecylbenzene sulfonic acid, dilaurylcetylbenzene sulfonic acid, polyisobutylene-substituted benzene sulfonic acids having a molecular weight of from about 300 to about 1000, naphthalene sulfonic acid and alkyl-substituted naphthalene sulfonic acid, and the magnesium, calcium and barium salts thereof.

4. A method as claimed in claim 1 in which said oil-soluble organic acid is calcium postdodecylbenzene sulfonate.

5. A method as claimed in claim 1 in which said compound (2) is selected from the group consisting of magnesium oxide, magnesium hydroxide, calcium oxide, calcium hydroxide, barium oxide and barium hydroxide.

6. A method as claimed in claim 1 in which (2) is calcium oxide or calcium hydroxide.

7. A method as claimed in claim 1 in which said dihydric alcohol is selected from the group consisting of ethylene glycol, propylene glycol, butylene glycol, amylene glycol, pentyne glycol, diethylene glycol, trimethylene glycol, 1,3-butylene glycol and hexylene glycol.

8. A method as claimed in claim 1 in which said dihydric alcohol is ethylene glycol.

9. A method as claimed in claim 1, in which the overbased lubricating oil additive obtained as a final product contains from about 30 to about 70 weight percent of said lubricating oil reaction medium, from about 4 to about 35 weight percent of alkaline earth metal carbonate and from about 20 to about 50 weight percent of alkaline earth metal salts of said organic acid and reaction products of component (2) and said accelerator composition.

10. A method as claimed in claim 1 in which in step I, component (1), component (2) and the lubricating oil are agitated at about 15° to 80° C to form a slurry.

11. A method as claimed in claim 1 in which in step II, the reaction temperature is from 150° to 200° C and the reaction time is from one to 5 hours.

12. A method as claimed in claim 1 in which in step III, the reaction temperature is from 150° to 200° C and the volatile substances are distilled off at a temperature above 200° C under a pressure of 10 to 50 mm Hg.

13. A method as claimed in claim 1 in which said oilsoluble organic acid is selected from the group consisting of 2-ethylhexyl carboxylic acid, myristic acid, palmitic acid, stearic acid, isostearic acid, oleic acid, linoleic acid, linolenic acid, tall oil fatty acids, hydrocarbonsubstituted lower alkyl carboxylic acids, naphthenic acids, alkyl and alkenyl-substituted dicarboxylic acids and mixtures thereof.

14. An overbased lubricating oil additive prepared by the method of claim 1.

15. An overbased lubricating oil additive as claimed in claim 14 having a metal ratio of higher than 5 and a total base number of higher than 250.

16. A lubricating oil composition containing from about 0.1 to 40 weight percent of the overbased lubricating oil additive claimed in claim 14.

17. A lubricating oil composition containing from about 10 to about 30 weight percent of the overbased lubricating oil additive claimed in claim 14.

* * * * *